US009094761B2

(12) United States Patent
Hickerson et al.

(10) Patent No.: US 9,094,761 B2
(45) Date of Patent: Jul. 28, 2015

(54) DIGITAL TECHNIQUE FOR FM MODULATION OF INFRARED HEADPHONE INTERFACE SIGNALS

(75) Inventors: Dallas Dwight Hickerson, Sharpsburg, GA (US); Joseph Cecil Whitaker, Sharpsburg, GA (US)

(73) Assignee: Panasonic Automotive Systems Company of America, Division of Panasonic Corporation of North America, Peachtree City, GA (US)

( * ) Notice: Subject to any disclaimer, the term of this patent is extended or adjusted under 35 U.S.C. 154(b) by 796 days.

(21) Appl. No.: 13/326,962

(22) Filed: Dec. 15, 2011

(65) Prior Publication Data

US 2013/0156215 A1 Jun. 20, 2013

(51) Int. Cl.
*H04R 1/10* (2006.01)

(52) U.S. Cl.
CPC ..... *H04R 1/1091* (2013.01); *H04R 1/1008* (2013.01); *H04R 2420/07* (2013.01)

(58) Field of Classification Search
CPC . H04R 1/1091; H04R 1/1008; H04R 2420/07
USPC ..... 381/74, 77, 79, 85
See application file for complete search history.

(56) References Cited

U.S. PATENT DOCUMENTS

2003/0199115 A1* 10/2003 Mattox ..... 438/48
2006/0153389 A1 7/2006 Temerinac et al.
2008/0218400 A1 9/2008 Stolarczyk et al.
2008/0318518 A1* 12/2008 Coutinho et al. ..... 455/3.06
2011/0043328 A1 2/2011 Bassali
2011/0188604 A1* 8/2011 Wagner ..... 375/302

OTHER PUBLICATIONS

PCT International Search Report mailed Mar. 28, 2013 by International Searching Authority, United States Patent and Trademark Office for PCT/US2012/069771, International Filing Date of Dec. 14, 2012.

PCT International Written Opinion mailed Mar. 28, 2013 by International Searching Authority, United States Patent and Trademark Office for PCT/US2012/069771, International Filing Date of Dec. 14, 2012.

* cited by examiner

*Primary Examiner* — Paul S Kim
(74) *Attorney, Agent, or Firm* — Laurence S. Roach, Esq.

(57) ABSTRACT

A method of modulating an infrared headphone interface signal includes providing a first audio signal having an analog audio value. A memory is provided having a plurality of locations and containing digital phase offset values. A clock signal having a clock frequency is provided. A second audio signal having a center carrier frequency that deviates with the analog audio value of the first audio signal is provided. An instantaneous value of the center carrier frequency is determined. The clock frequency is divided by the instantaneous carrier frequency value to calculate a number of samples per cycle. A number of location addresses in the memory is divided by the number of samples per cycle to calculate a memory access interval. The memory is accessed at addresses separated by the memory access interval. The digital phase offset values at the accessed memory addresses are used to reproduce the first audio signal.

20 Claims, 9 Drawing Sheets

DIGITAL TECHNIQUE FOR FM MODULATION OF INFRARED HEADPHONE INTERFACE SIGNALS

BACKGROUND OF THE INVENTION

1. Field of the Invention

The present invention relates to headphone interfaces, and, more particularly, to infrared headphone interfaces.

2. Description of the Related Art

Typical infrared (IR) headphone transmitters use analog FM modulators that require manual adjustment to calibrate the carrier frequencies. FIG. 1 is a schematic block diagram of an infrared (IR) headphone system of the prior art using analog technology. The audio is transmitted by an FM carrier (Left and Right channels at 2.3 MHz and 2.8 MHz carrier frequencies, respectively). The modulated frequency may be directly proportional to the instantaneous audio. That is, a maximum audio level would yield a maximum frequency. Alternately, the modulated frequency could be inversely proportional to the instantaneous audio. That is, a maximum audio level would yield a minimum frequency. However, in both cases, the audio level is related to the frequency deviation ±the carrier frequency.

Neither anticipated nor obvious in view of the prior art, however, is an IR headphone system using digital technology.

SUMMARY OF THE INVENTION

The invention may generate the modulated FM signal for an IR headphone system using digital techniques. The invention may provide a method of using direct digital synthesis to enable the use of a crystal oscillator that may not require adjustment, and to reduce the number of components as compared to analog techniques.

In both the analog and digital cases, the frequency of the FM transmitted signal may be proportional to the instantaneous audio information. A novel feature of the invention is the dimension of its sine wave look-up table relative to the digitized audio information. By careful and novel choice of memory size, the unmodified audio data may create the necessary memory address offset for the digital sine wave synthesis. This subsequently may reduce the number of logic resources needed for the address generator. Circuit simulation indicates that a Complex Programmable Logic Device (CPLD) of only 240 logic elements is sufficient for the address generator task, as demonstrated hereinbelow. Because the invention may not have any moving parts, the invention may be more reusable than known implementations.

The invention comprises, in one form thereof, a method of modulating an infrared headphone interface signal, including providing a first audio signal having an analog audio value. As used herein, the term "audio signal" may include a frequency modulated pulse signal. Phase shift keying or quadrature phase shift modulation may also be suitable for an audio signal. A memory is provided having a plurality of locations and containing digital phase offset values. A clock signal having a clock frequency is provided. A second audio signal having a center carrier frequency that deviates with the analog audio value of the first audio signal is provided. An instantaneous value of the center carrier frequency is determined. The clock frequency is divided by the instantaneous carrier frequency value to thereby calculate a number of samples per cycle. A number of location addresses in the memory is divided by the number of samples per cycle to thereby calculate a memory access interval. The memory is accessed at addresses separated by the calculated memory access interval. The digital phase offset values at the accessed memory addresses are used to reproduce the first audio signal by use of headphones.

The invention comprises, in another form thereof, an audio headphone arrangement including a source of a first audio signal having an analog audio value. A pair of audio headphones includes a memory device having a plurality of locations containing corresponding digital phase offset values. An infrared transmitter apparatus includes a clock generator producing a clock signal having a clock frequency. A receiver is in communication with the source of the first audio signal. A phase offset generator is in communication with the clock generator and with the receiver. The phase offset generator samples a second audio signal that is dependent on the first audio signal. A frequency of the sampling is dependent upon the clock signal. The phase offset generator also generates a phase offset signal dependent upon the sampling step. A phase accumulator is in communication with the phase offset generator and calculates a net phase value dependent upon the phase offset signal. The phase accumulator transmits an infrared signal to the headphones. The infrared signal is indicative of location addresses in the memory device to be accessed in order for the headphones to reproduce the first audio signal.

The invention comprises, in yet another form thereof, a method of operating headphones, including providing a memory having a plurality of locations and containing digital phase offset values. A second audio signal is provided having a center carrier frequency that deviates with an analog audio value of a first audio signal. An instantaneous value of the center carrier frequency is determined. A frequency of a clock signal is divided by the instantaneous carrier frequency value to thereby calculate a number of samples per cycle. A number of location addresses in the memory is divided by the number of samples per cycle to thereby calculate a memory access interval. An infrared signal indicating location addresses in the memory is transmitted. The location addresses are separated by the calculated memory access interval. The digital phase offset values at the accessed memory location addresses are used to reproduce the first audio signal by use of the headphones.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 1:
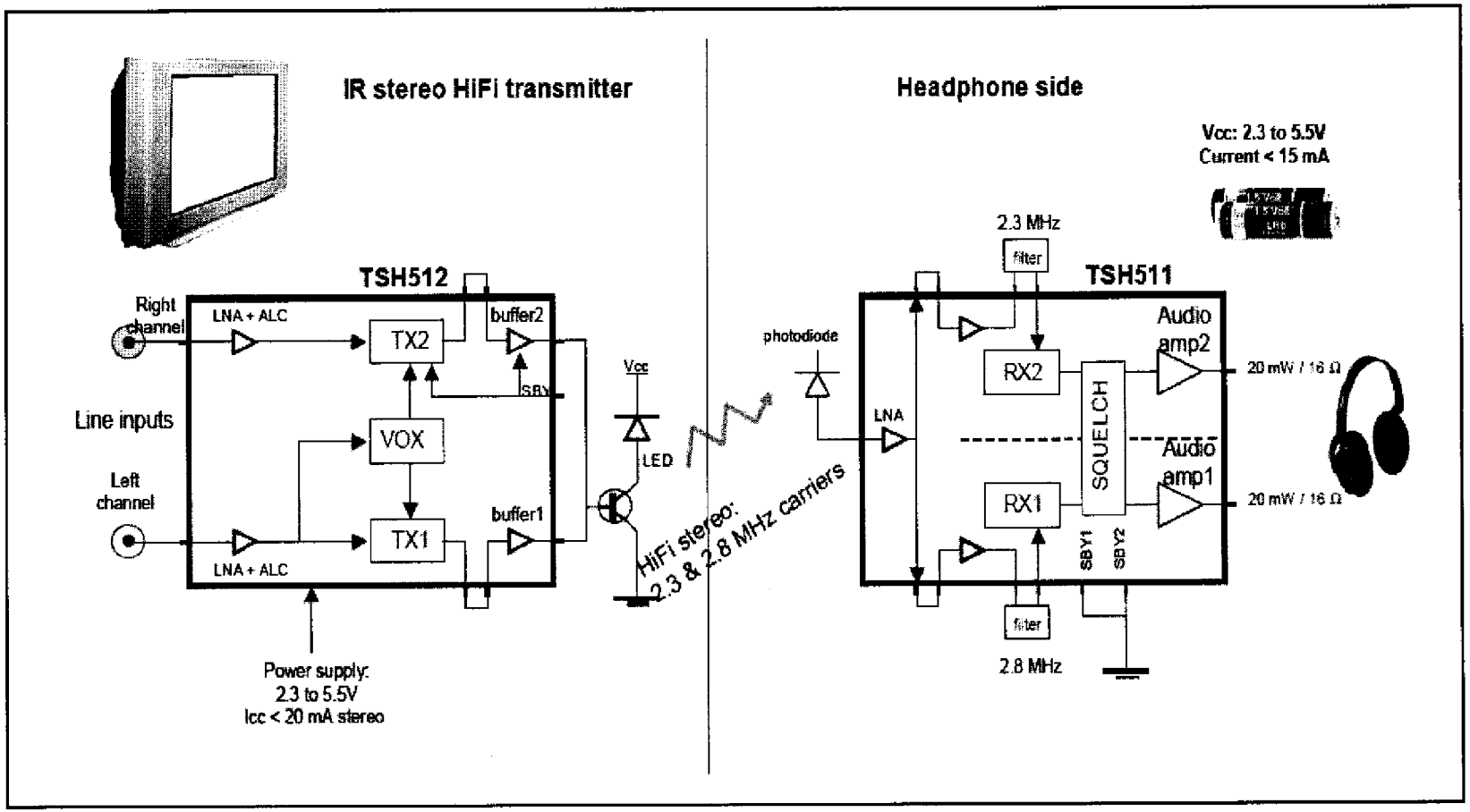
FIG. 1 PRIOR ART
FIG. 1 is a schematic block diagram of an infrared (IR) headphone system of the prior art using analog technology.
Figure 2:
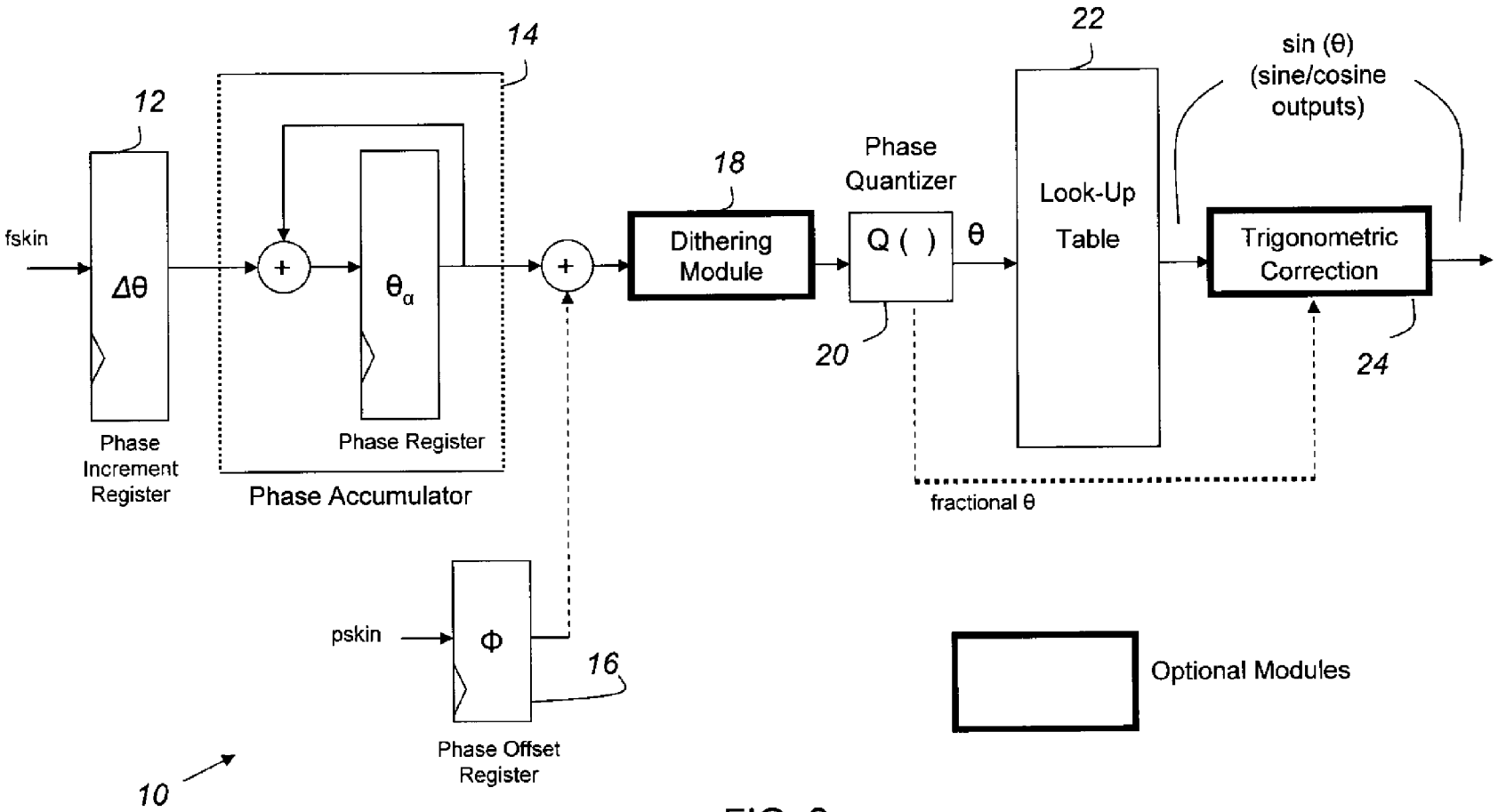
FIG. 2 is a block diagram illustrating one embodiment of a Direct Digital Synthesis system that may be incorporated in the present invention.

FIG. 2 is a block diagram illustrating one embodiment of a Direct Digital Synthesis system 10 that may be incorporated by the present invention. System 10 is in the form of a numerically controlled oscillator (NCO) produced by Lattice Semiconductor Corporation. System 10 includes a phase increment register 12 which may store the phase value ($\Delta\theta$) that gets added to the accumulated phase at every clock cycle. The phase increment linearly may determine the frequency of the output signal. Hence, this input may be used for frequency shift keying (FSK) modulation. The phase increment may be either fixed or read dynamically from an input port, fskin, depending on how the NCO is configured. The output frequency may be a fraction of the clock frequency of the system.

A phase accumulator 14 may compute the phase angle value that is used to address the look-up tables used for the output sine signal generation. The phase angle at any cycle is equal to the phase angle at the last cycle plus the phase increment. For cycle i, $\theta_i=\theta_{i-1}+\Delta\theta$.

The width of accumulator 14 may be determined by the user parameter, "Phase resolution". For a given accumulator width, phase resolution is highest when the phase increment is equal to one and is less for values greater than one.

A constant phase input may be added to the accumulated phase before addressing the look-up table. This may be useful for implementing phase shift keying (PSK) modulation of the NCO output. The user can choose no phase offset, a fixed phase offset or a variable phase offset (PSK). The variable offset may be applied through the PSK input (pskin) to phase offset register 16. Any phase offset that is added may cause a shift in the phase angle and a corresponding linear phase shift in the output sine signal.

The output of phase accumulator 14 (or of the optional PSK or dithering module 18) drives a quantizer 20. Quantizer 20 may scale down the accumulator output to reduce the size of look up table 22. Assuming look up table 22 has integer resolution, quantizer 20 may provide a mechanism for fractional phase increments. The Quantizer output width determines the depth of look-up table 22 and is normally less than the accumulator output width. This may enable high precision accumulation operation while using less memory.

Look-up table 22 may store the values of the sine wave corresponding to equally spaced phase angles in the $(0, 2\pi)$ interval. If the wave size parameter is equal to "half" or "quarter", sine wave samples corresponding to $(0, \pi)$ or $(0, \pi/2)$, respectively, may be stored in look-up table 22. As cosine can be derived from the sine of a shifted angle, the cosine value, if required, may be read from the same look-up table by manipulating the address. The depth of look-up table 22 may be a power of two and may be determined by the user defined parameter Quantizer resolution. The width of the look-up table may be, in most cases, equal to the output width. Look-up table 22 may be implemented using block or distributed memories, which may be selected by the user parameter Memory type. The memory may be addressed by the phase angle index, which may be generated by accumulator 14 and quantizer 20.

Storing half wave reduces the memory requirement by half, but uses slightly more logic and increases the latency by one cycle. Except for very small look-up table configurations, the user may better choose half wave storage to reduce memory usage. The user can also choose a quarter wave storage to reduce memory by another half (half of what is needed for a half wave storage). In the quarter-wave case, however, the latency increases by one cycle and additional logic may be used as compared to half-wave implementation.

Sum-of-Angles memory reduction may be implemented. As the sine wave samples are stored in memory in direct digital synthesis NCOs, increasing the phase resolution of the output leads to a corresponding increase in the size of the look-up table. The amount of memory required can be greatly reduced by making use of the "sum of angles" trigonometric identity and by using additional multipliers and adders after the memory output. This may be achieved by dividing the angle space into coarse sub-divisions and then writing the phase angle as a sum of the nearest coarse angle and an additive corrective angle (fine angle).

This sum of angle scheme may use four multipliers and two adders after the look-up table. However, the memory used may be much less as compared with the full wave scheme without sum of angles reduction. For a typical example of 16-bit quantizer resolution, sum of angles scheme can lead to more than 98% memory saving, compared to the full wave implementation.

The quality of output may be improved as described below. A common measure of the output quality of NCO is the Spurious Free Dynamic Range (SFDR). This roughly indicates the degree of power separation between the main lobe and the next strongest side lobe in the power spectral density plot. The SFDR can be improved using either phase dithering in block 18 or trigonometric correction in optional block 24. Phase dithering may diffuse the concentration of phase quantization noise by adding a small random value to the accumulated phase before quantization. Trigonometric correction serves to improve the SFDR in a more deterministic way by adding a correction factor computed from the discarded LSB bits, to the output. The SFDR for the NCO output without dithering or trigonometric correction is approximately equal to six time the quantizer resolution.

In one embodiment, the digital IR headphone interface is a variation of the basic direct digital synthesis system of FIG. 2. A novel feature of this embodiment is that the dimensions of Look-Up Table 22 may be chosen such that the Phase Offset Register function can be performed by the raw digital audio data. While this may require a relatively large memory space, the logic requirements may be greatly reduced.

Regardless of whether an analog or digital technique is used, it may be necessary to vary the transmittal frequency at the audio rate.

Figure 3:
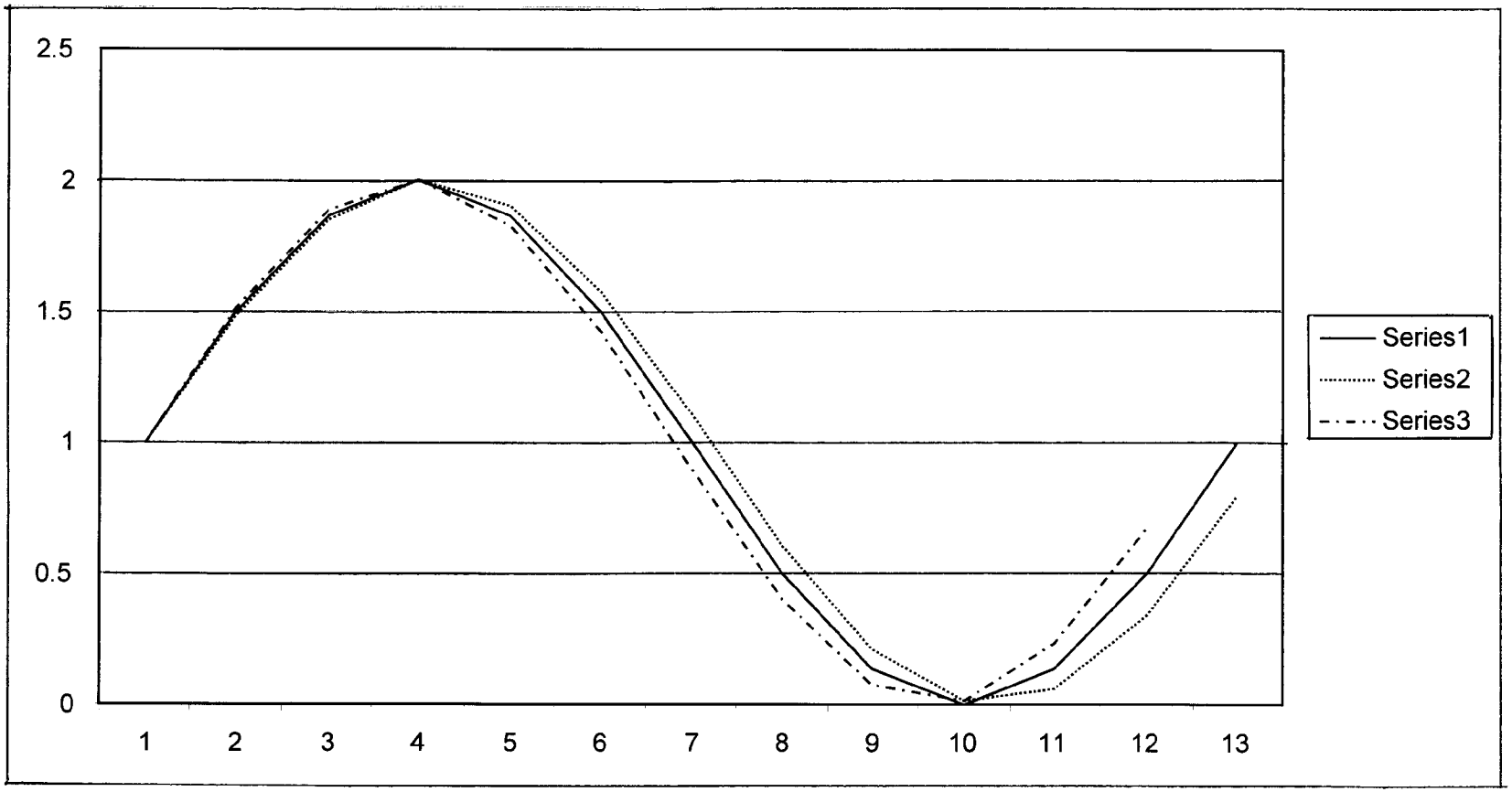
FIG. 3 is an example plot of sine wave generation by phase offset according to one embodiment of the invention.

FIG. 3 is an example plot of sine wave generation by phase offset according to one embodiment of the invention. FIG. 3 illustrates the concept of using phase-offset to generate Sine waves of different frequencies. In this case, a 360 element look-up table may be used. The 360 elements themselves may be the Sine values around a unit circle in one degree increments. A constant of one may be added to the results so that all values are positive. In creating the plot of FIG. 3, the contents of the look-up table were read in twenty-nine word increments (Series 2), thirty word increments (Series 1), and thirty-one word increments (Series 3).

The output frequency is directly proportional to the phase-offset value. The greater the offset value, the higher the resulting frequency.

In one embodiment, a sixteen million element look-up table may be used, the contents of which may be read in one of sixty-four thousand incremental values, depending on the instantaneous value of the digital audio information. For the sake of illustration, consider an example IR Headphone system with 2 MHz carrier frequency and 100 KHz deviation. The master clock can be provided by a crystal oscillator whose inherent accuracy offers an advantage over typical systems that require individual frequency adjustment during manufacturing. In this case, a master clock of 24.576 MHz lends itself to digital audio applications, providing the required auxiliary clocks by a simple divider:

24.576 MHz÷512=48 KHz(sample rate=Left/Right Clock,"LRCLK")

24.576 MHz÷8=3.072 MHz(64×sample rate=bit clock,"BCK")

Further, the 24.576 MHz can be used directly as the sample clock for the output (modulated) 2 MHz Sine wave.

The example system with 2 MHz carrier and 100 kHz deviation would have an upper frequency of 2.05 MHz and a lower frequency of 1.95 MHz. Sampled at 24.576 MHz, this would yield the following "samples/cycle".

1.95 MHz=12.603 Samples @24.576 MHz.
2.00 MHz=12.229 Samples @24.576 MHz.
2.05 MHz=11.988 Samples @24.576 MHz.

Obviously, there is very little difference in the number of samples across the frequency extremes of 2 MHz±50 kHz. If a memory with a 16-bit address bus (64 kB) is used, the number of memory locations would be 65536. Dividing that memory space by the number of samples at the two frequency extremes (12.603 at 1.95 MHz and 11.988 at 2.05 MHz) will yield the possible number of phase-offset values—the "Delta" shown in FIG. 4.

In this case, if the instantaneous audio value is maximum, the memory may be accessed at addresses with intervals of 5467 (65536/11.988) like this:

Address of $1^{st}$ word: 5467×0=0
Address of $2^{nd}$ word: 5467×1=5467
Address of $3^{rd}$ word: 5467×2=10934
Address of $4^{th}$ word: 5467×3=16401
Address of $5^{th}$ word: 5467×4=21868
Address of $6^{th}$ word: 5467×5=27335
Address of $7^{th}$ word: 5467×6=32802
Address of $8^{th}$ word: 5467×7=38269
Address of $9^{th}$ word: 5467×8=43736
Address of $10^{th}$ word: 5467×9=49203
Address of $11^{th}$ word: 5467×10=54670
Address of $12^{th}$ word: 5467×11=60137

If the instantaneous audio value is minimum, the memory may be accessed at intervals of 5200 like this:

Address of $1^{st}$ word: 5200×0=0
Address of $2^{nd}$ word: 5200×1=5200
Address of $3^{rd}$ word: 5200×2=10400
Address of $4^{th}$ word: 5200×3=15600
Address of $5^{th}$ word: 5200×4=20800
Address of $6^{th}$ word: 5200×5=26000
Address of $7^{th}$ word: 5200×6=31200
Address of $8^{th}$ word: 5200×7=36400
Address of $9^{th}$ word: 5200×8=41600
Address of $10^{th}$ word: 5200×9=46800
Address of $11^{th}$ word: 5200×10=5200
Address of $12^{th}$ word: 5200×11=57200
Address of $13^{th}$ word: 5200×12=62400

Expressed another way, given a 64 kB memory space (look-up table), there are only 267 possible phase-offset values. Since the phase-offset establishes the frequency and the varying frequency carries the audio information, the result is an audio signal with only 267 discrete values, which is roughly equivalent to eight-bit audio.

Figure 5:
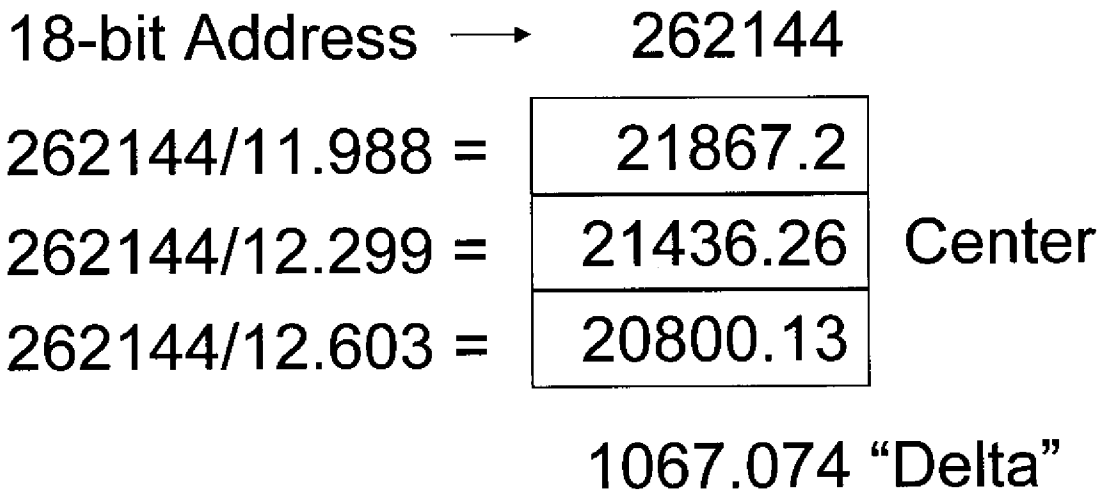
FIG. 5 is a table showing the number of possible phase-offset values obtained by dividing a 256 kB memory by the number of samples of carrier frequencies of 1.95 MHz, 2.00 MHz and 2.05 MHz at a master clock frequency of 24.576 MHz.

Similarly, a 256 kB memory size yields an audio bit resolution of approximately 10-bits, as illustrated in FIG. 5. That is, the delta of 1067 yields 1067 possible discrete phase-offset values, which is roughly equivalent to ten-bit audio.

Figure 6:
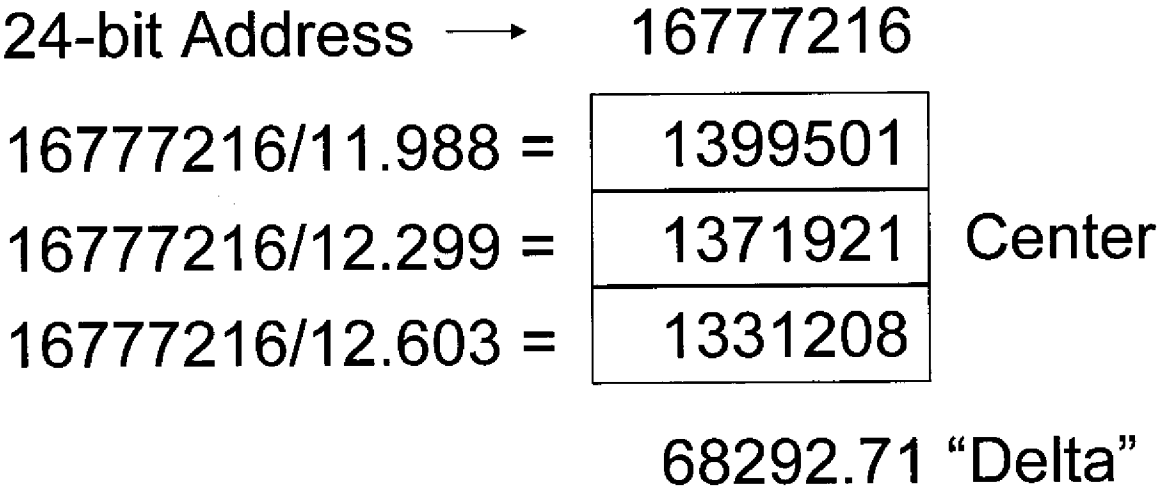
FIG. 6 is a table showing the number of possible phase-offset values obtained by dividing a 16 MB memory by the number of samples of carrier frequencies of 1.95 MHz, 2.00 MHz and 2.05 MHz at a master clock frequency of 24.576 MHz.

Finally, a 16 MB memory size yields CD quality with an audio bit resolution of approximately 16-bits, as illustrated in FIG. 6. That is, the delta of 68293 yields 68293 possible discrete phase-offset values, which is roughly equivalent to sixteen-bit audio.

Figure 7:
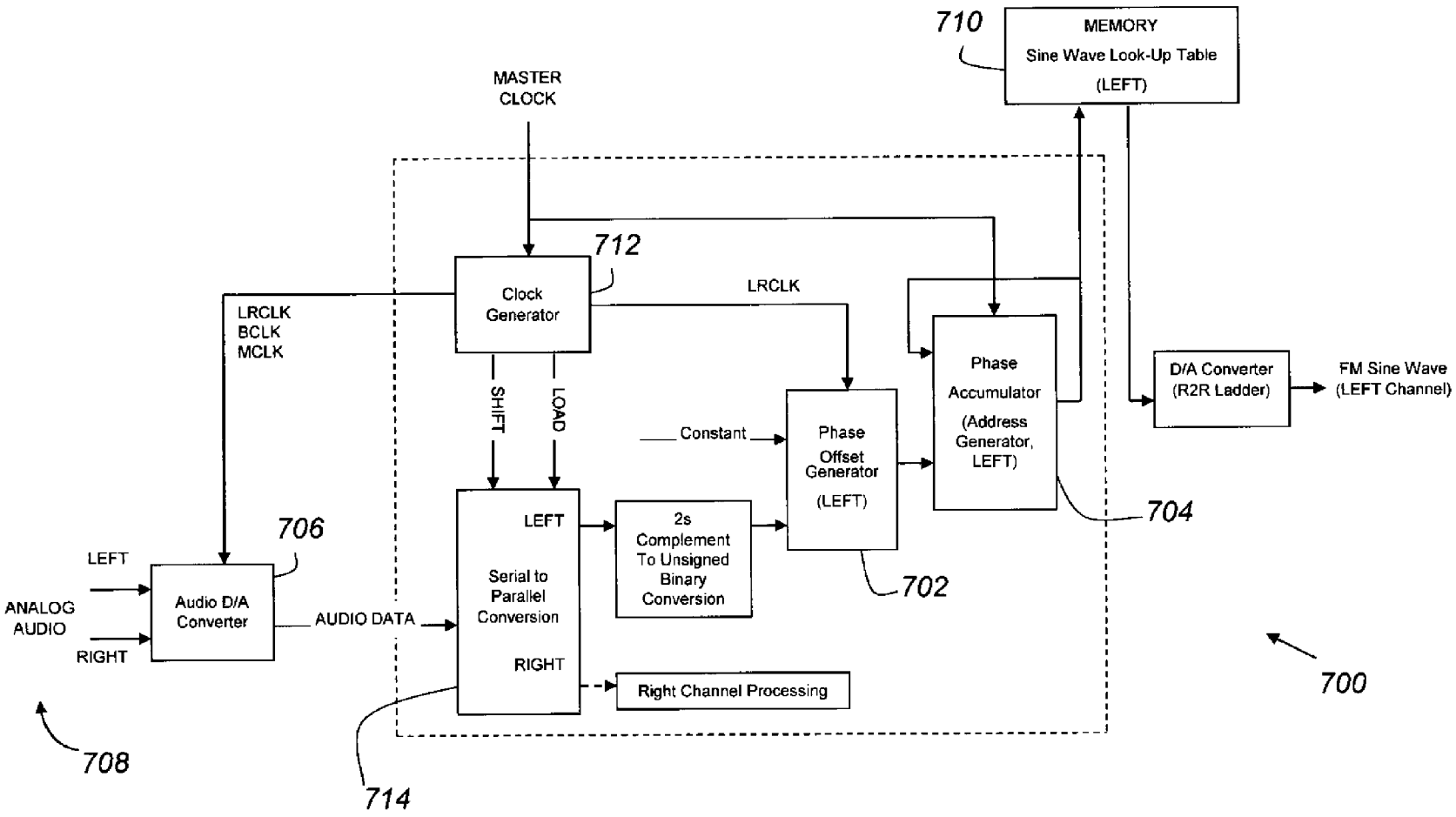
FIG. 7 is an audio headphone arrangement with detail of the left-channel audio processing according to one embodiment of the present invention.

At this point, with 16 MB external memory, 16-bit digital audio can serve as the "phase offset generator" as shown in the embodiment of FIG. 7, which is an IR headphone transmitter 700 with detail of the left-channel audio processing being shown. The "Constant" value shown as an input to the Phase Offset Generator 702 may be used to establish the Center Frequency, i.e., 2 MHz in the example discussed above. The Constant plus the 16-bit digital audio (applied in unsigned binary format) may provide the necessary input to the Phase Accumulator 704. This design was simulated using a constant value of 0x145008 which, when added to the mid-point (that is, "silent") audio value of 0x8000, would yield a 2 MHz carrier. An audio analog to digital converter 706 may use the clock signal to digitize the analog audio signal. The audio signal transmitted to the headphones is dependent upon the digitized analog audio signal.

Figure 8:
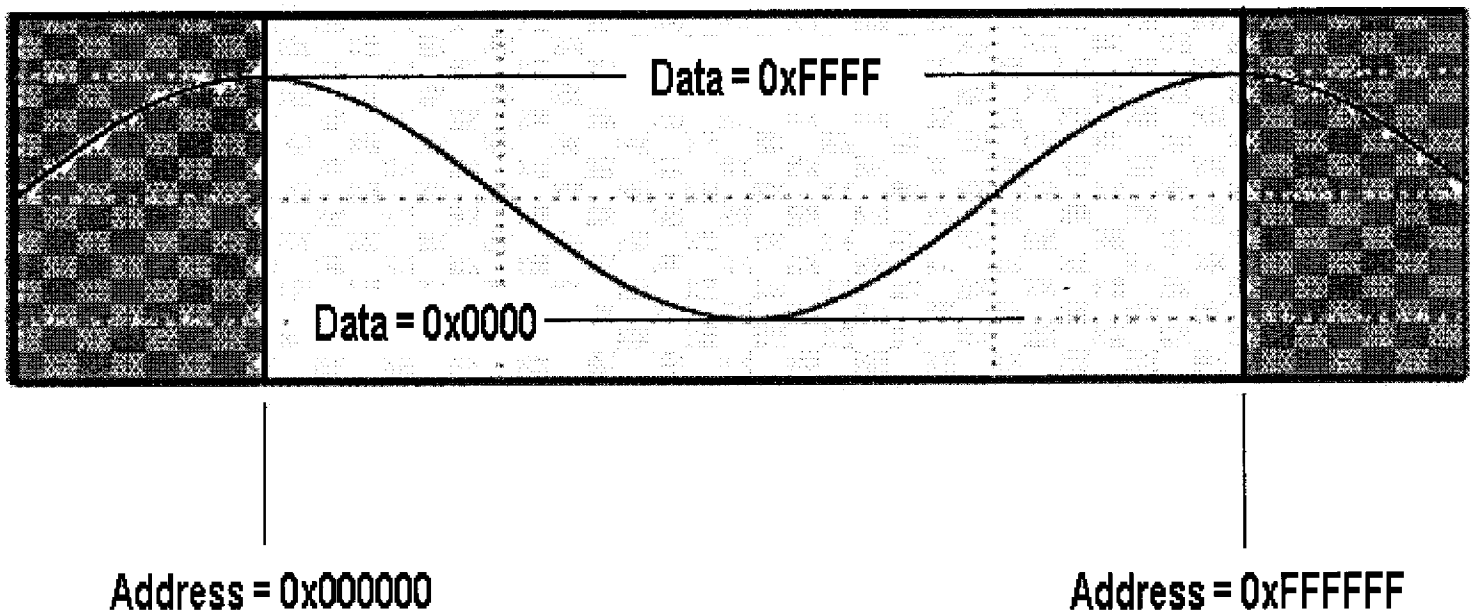
FIG. 8 is an example plot of the digital phase offset values stored in the address locations of a look-up table according to one embodiment of the present invention.

FIG. 8 below illustrates the memory contents, essentially a look-up table whose contents are a high-resolution Sine wave. The digital phase offset values sinusoidally oscillate with a progression along the memory locations.

Figure 9:
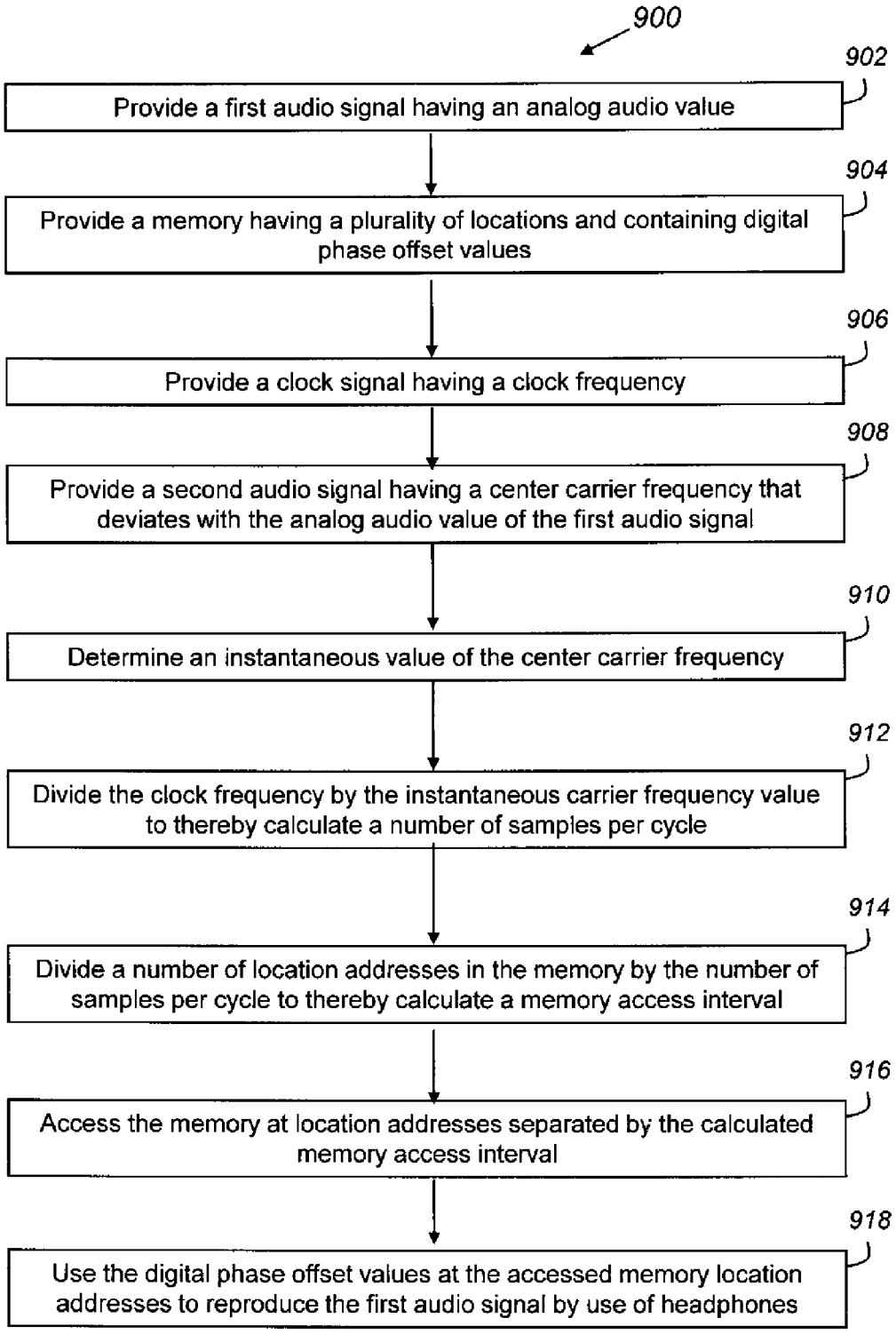
FIG. 9 is a flow chart of one embodiment of a method of the invention for modulating an infrared headphone interface signal.

A method 900 of the invention for modulating an infrared headphone interface signal is illustrated in FIG. 9. In a first step 902, a first audio signal having an analog audio value is provided. For example, as shown in FIG. 7, an analog audio signal 708 has, in this case, left and right analog audio values which are input to audio A/D converter 706.

Figure 4:
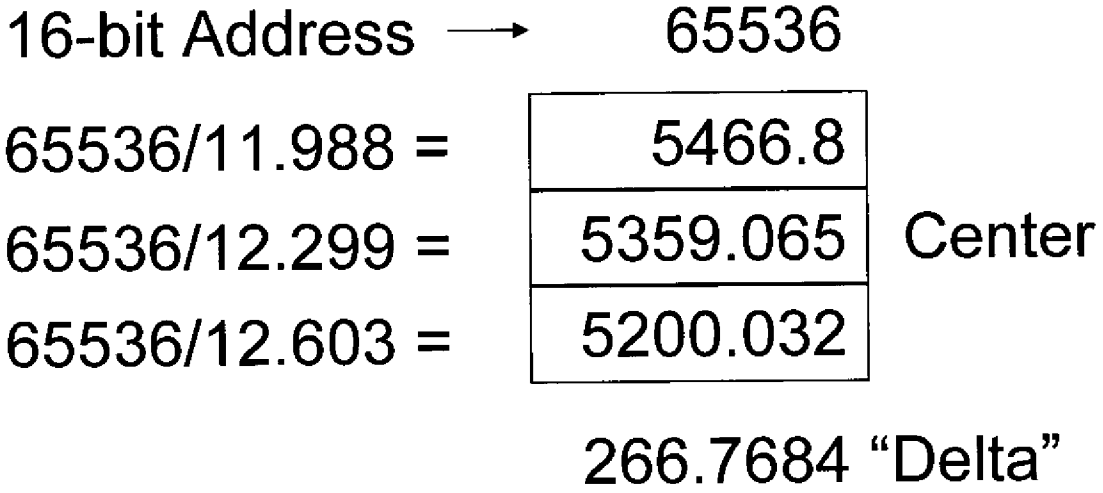
FIG. 4 is a table showing the number of possible phase-offset values obtained by dividing a 64 kB memory by the number of samples of carrier frequencies of 1.95 MHz, 2.00 MHz and 2.05 MHz at a master clock frequency of 24.576 MHz.

In step 904, a memory having a plurality of locations and containing digital phase offset values is provided. In the embodiment of FIG. 7, a memory device 710 may have, for example, 65536 address locations as shown in FIG. 4. Each of the memory locations may store a different, respective digital phase offset value. The digital phase offset values may vary sinusoidally with a progression along the memory locations, as shown in FIGS. 3 and 8.

Next, in step 906, a clock signal having a clock frequency is provided. For example, clock generator 712 (FIG. 7) provides a clock signal having a clock frequency of 24.576 MHz to audio A/D converter 706, serial-to-parallel conversion block 714, and phase offset generator 702.

In a next step 908, a second audio signal having a center carrier frequency that deviates with the analog audio value of the first audio signal is provided. That is, clock generator 712 may provide a 2 MHz carrier which deviates between an upper frequency of 2.05 MHz and a lower frequency of 1.95 MHz along with an analog audio value of analog audio signal 708.

In step 910, an instantaneous value of the center carrier frequency is determined. For example, the 2 MHz carrier signal may be sampled at a rate of 24.576 MHz in order to determine its instantaneous value.

Next, in step 912, the clock frequency is divided by the instantaneous carrier frequency value to thereby calculate a number of samples per cycle. That is, the clock frequency of 24.576 MHz is divided by the carrier signal frequency of about 2 MHz to yield approximately 12 samples per cycle.

In a next step 914, a number of location addresses in the memory is divided by the number of samples per cycle to thereby calculate a memory access interval. In the example of FIG. 4, 65536 memory location addresses are divided by the approximate 12 samples per cycle to thereby calculate a memory access interval of approximately between 5200 and 5467.

In step 916, the memory at location addresses separated by the calculated memory access interval are accessed. That is, the digital phase offset values stored at location addresses that are separated by approximately between 5200 and 5467 address locations are read.

In a final step 918, the digital phase offset values at the accessed memory location addresses are used to reproduce the first audio signal by use of headphones. For example, the digital phase offset values read from the memory may be translated within the headphones into an audio signal that is a reproduction of analog audio signal 708. This reproduced audio signal may be directly converted into sound by the speakers of the headphones.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method for modulating an infrared headphone interface signal, comprising the steps of:

providing a first audio signal having an analog audio value;

providing a memory having a plurality of locations and containing digital phase offset values;

providing a dock signal having a dock frequency;

providing a second audio signal having a center carrier frequency that deviates with the analog audio value of the first audio signal;

determining an instantaneous value of the center carrier frequency;

dividing the dock frequency by the instantaneous carrier frequency value to thereby calculate a number of samples per cycle;

dividing a number of location addresses in the memory by the number of samples per cycle to thereby calculate a memory access interval;

accessing the memory at location addresses separated by the calculated memory access interval; and using the digital phase offset values at the accessed memory location addresses to reproduce the first audio signal by use of headphones.

2. The method of claim 1 wherein the center carrier frequency has a deviation frequency range between a minimum carrier frequency corresponding to a minimum said analog audio value, and a maximum carrier frequency corresponding to a maximum said analog audio value.

3. The method of claim 1 wherein the memory is disposed within the headphones.

4. The method of claim 1 wherein the accessing step includes transmitting an infrared signal including the addresses separated by the calculated memory access interval.

5. The method of claim 4 wherein the infrared signal is transmitted to the headphones.

6. The method of claim 1 wherein the digital phase offset values sinusoidaliy oscillate with a progression along the memory locations.

7. The method of claim 1 comprising the further step of establishing the center carrier frequency by entering a corresponding constant value into a phase offset generator.

8. An audio headphone arrangement, comprising:

a source of a first audio signal having an analog audio value;

a pair of audio headphones including a memory device having a plurality of locations containing corresponding digital phase offset values; and an infrared transmitter apparatus including:

a clock generator configured to produce a dock signal having a dock frequency;

a receiver in communication with the source of the first audio signal;

a phase offset generator in communication with the dock generator and with the receiver, the phase offset generator being configured to:

sample a second audio signal that is dependent on the first audio signal, a frequency of the sampling being dependent upon the dock signal; and generate a phase offset signal dependent upon the sampling step; and a phase accumulator in communication with the phase offset generator and configured to:

calculate a net phase value dependent upon the phase offset signal; and transmit an infrared signal to the headphones, the infrared signal being indicative of location addresses in the memory device to be accessed in order for the headphones to reproduce the first audio signal.

9. The arrangement of claim 8 wherein a constant value is an input to the phase offset generator, the phase offset generator being configured to use the constant value input to establish a center frequency of the second audio signal.

10. The arrangement of claim 8 wherein the memory device has a size approximately between 16 kilobytes and 16 megabytes.

11. The arrangement of claim 8 wherein the second audio signal has a center carrier frequency with a deviation frequency range between a minimum carrier frequency corresponding to a minimum value of the first audio signal, and a maximum carrier frequency corresponding to a maximum value of the first audio signal.

12. The arrangement of claim 8 wherein the digital phase offset values sinusoidally oscillate with a progression along the location addresses of the memory device.

13. The arrangement of claim 8 wherein the infrared signal is dependent upon the net phase value.

14. The arrangement of claim 8 further comprising an audio analog to digital converter configured to use the clock signal to digitize the first audio signal, the second audio signal being dependent upon the first audio signal.

15. A method of operating headphones, comprising the steps of:

providing a memory having a plurality of locations and containing digital phase offset values;

providing a second audio signal having a center carrier frequency that deviates with an analog audio value of a first audio signal;

determining an instantaneous value of the center carrier frequency;

dividing a frequency of a dock signal by the instantaneous carrier frequency value to thereby calculate a number of samples per cycle;

dividing a number of location addresses in the memory by the number of samples per cycle to thereby calculate a memory access interval;

transmitting an infrared signal indicating location addresses in the memory, the location addresses being separated by the calculated memory access interval; and using the digital phase offset values at the accessed memory location addresses to reproduce the first audio signal by use of the headphones.

16. The method of claim 15 wherein the accessed memory location addresses each correspond to a respective word.

17. The method of claim 15 wherein the center carrier frequency has a deviation frequency range between a minimum carrier frequency corresponding to a minimum said analog audio value, and a maximum carrier frequency corresponding to a maximum said analog audio value.

18. The method of claim 15 wherein the memory is disposed within the headphones.

19. The method of claim 15 wherein the infrared signal is transmitted to the headphones.

20. The method of claim 15 wherein a digital phase offset values sinusoidally oscillate with a progression along the memory location addresses.

* * * * *